US006042986A

United States Patent [19]

Dickerson et al.

[11] Patent Number: 6,042,986

[45] **Date of Patent: *Mar. 28, 2000**

[54] PORTAL LOCALIZATION RADIOGRAPHIC ELEMENT AND METHOD OF IMAGING

[75] Inventors: Robert E. Dickerson, Hamlin; Stephen A. Hershey, Fairport; James C. Bolthouse, Spencerport, all of N.Y.

[73] Assignee: Eastman Kodak Company, Rochester, N.Y.

[ * ] Notice: This patent is subject to a terminal disclaimer.

[21] Appl. No.: 09/069,390

[22] Filed: Apr. 29, 1998

[51] Int. Cl.[7] ..... G03C 5/16; G03C 5/17

[52] U.S. Cl. ..... 430/139; 430/502; 430/510; 430/944; 430/966

[58] Field of Search ..... 430/139, 944, 430/502, 966, 510

[56] References Cited

U.S. PATENT DOCUMENTS

| | | | |
|---|---|---|---|
| 4,414,304 | 11/1983 | Dickerson . | |
| 4,425,425 | 1/1984 | Abbott et al. . | |
| 4,425,426 | 1/1984 | Abbott et al. . | |
| 4,803,150 | 2/1989 | Dickerson et al. . | |
| 4,868,399 | 9/1989 | Sephton . | |
| 4,900,652 | 2/1990 | Dickerson et al. . | |
| 5,252,442 | 10/1993 | Dickerson et al. . | |
| 5,260,178 | 11/1993 | Harada et al. . | |
| 5,773,206 | 6/1998 | Hershey et al. | 430/510 |
| 5,871,892 | 2/1999 | Dickerson et al. | 430/502 |

OTHER PUBLICATIONS

Research Disclosure, vol. 184, Aug. 1979, Item 18431.

*Primary Examiner*—Thorl Chea
*Attorney, Agent, or Firm*—Carl O. Thomas

[57] ABSTRACT

Portal localization radiographic elements and a process of confirming the targeting of a beam of X-radiation of from 4 to 25 MVp using the portal radiographic elements are disclosed. The X-radiation is directed at a subject containing features that are identifiable by differing levels of X-radiation absorption. After a first X-radiation exposure a shield containing a portal is placed between the subject and the source of X-radiation. X-radiation is directed at the subject through the portal. In each instance the X-radiation leaving the subject impinges on a metal screen, causing it to emit electrons, and the electrons impinge upon a fluorescent screen, causing it to emit light, creating during the first and second exposures first and second superimposed latent images in the radiographic element. A processor is employed to convert the latent images to viewable silver images from which intended targeting of the X-radiation passing through the portal in relation to the identifiable features of the subject is realized. The processor relies on attenuation of an infrared beam of a wavelength from 850 to 1100 nm by the radiographic element for activation, and at least one of the hydrophilic colloid layers of the radiographic element contains particles having an index of refraction in the wavelength range of from 850 to 1100 nm that differs from that of the hydrophilic colloid by at least 0.2 to create a specular density capable of attenuating the infrared beam and activating the processor.

15 Claims, No Drawings

PORTAL LOCALIZATION RADIOGRAPHIC ELEMENT AND METHOD OF IMAGING

FIELD OF THE INVENTION

The invention is directed to portal localization radiography with radiation therapy treatment beams and to silver halide radiographic elements and intensifying screens for use in portal localization radiography.

DEFINITION OF TERMS

All references to silver halide grains and emulsions containing two or more halides name the halides in order of ascending concentrations.

The terms "high bromide" and "high chloride" in referring to silver halide grains and emulsions indicate greater than 50 mole percent bromide or chloride, respectively, based on total silver.

The term "equivalent circular diameter" or "ECD" indicates the diameter of a circle having an area equal to the projected area of a grain or particle.

The term "size" in referring to grains and particles, unless otherwise described, indicates ECD.

The term "aspect ratio" indicates the ratio of grain ECD to grain thickness (t).

"Compact particles" are those having an average aspect ratio of less than 2.0.

The "coefficient of variation" (COV) of grain size (ECD) is defined as 100 times the standard deviation of grain size divided by mean grain size.

The term "metal intensifying screen" refers to a metal screen that absorbs MVp level X-radiation to release electrons and absorbs electrons that have been generated by X-radiation prior to reaching the screen.

The term "fluorescent intensifying screen" refers to a screen that absorbs electrons emitted by a metal intensifying screen and emits light.

The term "rare earth" is used to indicate elements having an atomic number of 39 or 57 through 71.

The term "radiographic element" is employed to designate an element capable of producing a viewable silver image upon (a) imagewise direct or indirect (interposed intensifying screen) exposure to X-radiation followed by (b) rapid access processing.

The term "dual-coated" is employed to indicate radiographic elements having image forming layer units coated on opposite sides of a support.

The terms "front" and "back" refer to features or elements nearer to and farther from, respectively, the X-radiation source than the support of the radiographic element.

The term "crossover" as herein employed refers to the percentage of light emitted by a fluorescent intensifying screen that strikes a dual-coated radiographic film and passes through its support to reach the image forming layer unit coated on the opposite side of the support.

The term "RAD" is used to indicate a unit dose of absorbed radiation: an energy absorption of 100 ergs per gram of tissue.

The terms "kVp" and "MVp" stand for peak voltage applied to an X-ray tube X $10^3$ and $10^6$, respectively.

The term "portal" is used to indicate radiographic imaging, films and intensifying screens applied to megavoltage radiotherapy conducted through an opening or port in a radiation shield.

The term "localization" refers to portal imaging that is used to locate the port in relation to the surrounding anatomy of the patient. Typically exposure times range from 1 to 10 seconds.

The terms "rapid access processing" and "rapid access processor" are employed to indicate a capability of providing dry-to-dry processing in 90 seconds or less. The term "dry-to-dry" is used to indicate the processing cycle that occurs between the time a dry, imagewise exposed element enters a processor to the time it emerges, developed, fixed and dry.

The term "fully forehardened" is employed to indicate the forehardening of hydrophilic colloid layers to limit weight gain during rapid access processing to less than 120 percent of the original dry weight of the hydrophilic colloid.

The term "image tone" refers to appearance of an imaged portal radiographic element on a continuum ranging from cold (i.e., blue-black) to warm (i.e., brown-black) image tones. Image tone is measured in terms of CIE L*a*b* color space using b* values quantify image tone on a blue-yellow color axis. More positive b* values indicate a tendency toward greater yellowness (image warmth). A technique for measurement of b* values is described by Billmeyer and Saltzman, *Principles of Color Technology*, 2nd Ed., Wiley, N.Y. 1981, at Chapter 3.

The term "contrast" as herein employed indicates the average contrast (also referred to as γ) derived from a characteristic curve of a portal radiographic element using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta \log_{10}E$ ($\log_{10}E_2 - \log_{10}E_1$), $E_1$ and $E_2$ being the exposure levels at the reference points (1) and (2).

The term "covering power" is used to indicate the ratio of density to silver coating coverage and is usually expressed as a percentage.

The term "near infrared" refers to infrared radiation having wavelengths ranging to as long as 1100 nm.

The term "specular density" refers to the density an element presents to a perpendicularly intersecting beam of radiation where penetrating radiation is collected within a collection cone having a half angle of less than 10°, the half angle being the angle that the wall of the cone forms with its axis, which is aligned with the beam. For a background description of density measurement, attention is directed to Thomas, *SPSE Handbook of Photographic Science and Engineering*, John Wiley & Sons, New York, 1973, starting at p. 837.

*Research Disclosure* is published by Kenneth Mason Publications, Ltd., Dudley House, 12 North St., Emsworth, Hampshire PO10 7DQ, England.

BACKGROUND

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5 percent or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element. For medical diagnostic imaging, film contrast typically ranges from about 1.8 to 3.2, depending upon the diagnostic application.

Crossover of light from one fluorescent screen to an emulsion layer on the opposite side of the support of the radiographic element results in a significant loss of image sharpness. Crossover is minimized, since this degrades image sharpness and creates the risk of the radiologist failing to observe a significant anatomical feature required for a proper diagnosis. At worst crossover in medical diagnostic elements can range up to about 25 percent, but in the overwhelming majority of medical diagnostic element constructions is less than 20 percent and, in preferred medical diagnostic radiographic elements, crossover is substantially eliminated.

Medical diagnostic X-radiation exposure energies vary from about 25 kVp for mammography to about 140 kVp for chest X-rays.

Examples of radiographic element constructions for medical diagnostic purposes are provided by Abbott et al U.S. Pat. Nos. 4,425,425 and 4,425,426, Dickerson U.S. Pat. No. 4,414,304, Kelly et al U.S. Pat. Nos. 4,803,150 and 4,900,652, Tsaur et al U.S. Pat. No. 5,252,442, and *Research Disclosure*, Vol. 184, August 1979, Item 18431.

Portal radiography is used to provide images to position and confirm radiotherapy in which the patient is given a dose of high energy X-radiation (from 4 to 25 MVp) through a port in a radiation shield. The object is to line up the port with a targeted anatomical feature (typically a tumor) so the feature receives a cell killing dose of X-radiation. In localization imaging the portal radiographic element is briefly exposed to the X-radiation passing through the patient with the shield removed and then with the shield in place. Exposure without the shield provides a faint image of anatomical features that can be used as orientation references near the target (e.g., tumor) area while the exposure with the shield superimposes a second image of the port area. The exposed localization radiographic element is quickly processed to produce a viewable image and to confirm that the port is in fact properly aligned with the intended anatomical target. During the above procedure patient exposure to high energy X-radiation is kept to a minimum. The patient typically receives less than 20 RADs during this procedure.

Thereafter, before the patient is allowed to move, a cell killing dose of X-radiation is administered through the port. The patient typically receives from 50 to 300 RADs during this step. Since any movement of the patient between the localization exposure and the treatment exposure can defeat the entire alignment procedure, the importance of minimizing the time elapsed during the element processing cycle is apparent. Thus, rapid access processing, which is commonly employed in medical diagnostic imaging, serves an even more important need when applied to this application.

A proposed portal radiographic element construction is disclosed by Sephton U.S. Pat. No. 4,868,399. Sephton does not disclose rapid access processing or a film construction capable of undergoing rapid access processing. Sephton further shows dual-coated structures to produce unsatisfactorily low levels of contrast.

Medical diagnostic imaging has in recent years learned to employ silver halide emulsions at silver coating coverages of less than 30 mg/dm$^2$ by employing tabular grain emulsions. The high ratio of grain projected area to thickness allows high levels of silver image covering power to be realized, as first observed by Dickerson U.S. Pat. No. 4,414,304. The relatively high speeds of tabular grain emulsions render them unsuitable for use in use in portal imaging.

While lower silver coating coverages are in themselves advantageous in saving materials and facilitating rapid access processing, the low silver coverages have presented a problem in using commercially available rapid access processors, since they lack sufficient infrared density to be detected by the sensor beams used to sense the presence of radiographic film in rapid access processors.

Recent attempts to substitute high chloride silver halide emulsions for the high bromide silver halide emulsions most commonly employed in radiographic imaging have compounded the problem. Silver chloride exhibits a significantly lower refractive index than silver bromide and therefore creates lower specular densities when otherwise comparable grains are present at the same coating coverages. When coating coverages are less than 30 mg/dm$^2$, the problem of detecting the presence of radiographic elements is compounded.

Harada et al U.S. Pat. No. 5,260,178 has noted that with low silver coating coverages in radiographic elements, it is impossible for sensors that rely on the scattering of near infrared sensor beams by silver halide grains to sense the presence of the film in the processor. The solution proposed is to incorporate an infrared absorbing dye. Instead of reducing specular density by scattering near infrared radiation, the dye simply absorbs the near infrared radiation of the sensor beam. During processing the dye is deaggregated to shift its absorption peak. In the later stages of processing the density of developed silver is relied upon for interrupting sensor beams, which is the conventional practice.

The difficulty with the Harada et al solution to the problem of insufficient silver halide grain coating coverages to activate infrared sensors is that it relies on the addition of a complex organic material—specifically a tricarbocyanine dye that must have, in addition to the required chromophore for near infrared absorption, a steric structure suitable for aggregation and solubilizing substituents to facilitate deaggregation. The dyes of Harada et al also present the problem of fogging the radiation-sensitive silver halide grains when coated in close proximity, such as in a layer contiguous to a radiation-sensitive emulsion layer.

Simply stated, the "cure" that Harada proposes is sufficiently burdensome as to entirely offset the advantage of reduced silver coating coverages, arrived at by years of effort by those responsible for improving films for producing silver images in response to rapid access processing. Thus, Harada's film structure modification is not a problem solution that has practical appeal.

Dickerson et al U.S. Pat. No. 5,871,892, discloses a process of portal localization and portal verification imaging. The radiographic elements are capable of rapid access processing.

Hershey et al U.S. Pat. No. 5,773,206, discloses an element capable of forming a silver image containing insufficient radiation-sensitive silver halide grains to render the element detectable by an infrared sensor of a rapid access processor. The element has been modified to increase infrared specular density by the inclusion of, in a hydrophilic colloid dispersing medium, particles (a) removable from the element during a rapid access processing cycle, (b) having a mean size of from 0.3 to 1.1 $\mu$m and at least 0.1 $\mu$m larger than the mean grain size of the radiation-sensitive grains, and (c) having an index of refraction at the wavelength of the infrared radiation that differs from the index of refraction of the hydrophilic colloid by at least 0.2.

RELATED APPLICATIONS

Dickerson et al U.S. Ser. No. 09/069.528, filed concurrently herewith and commonly assigned, now allowed, titled PORTAL VERIFICATION RADIOGRAPHIC ELEMENT AND METHOD OF IMAGING, discloses a method of portal verification imaging employing a radiographic element specifically constructed for this use.

SUMMARY OF THE INVENTION

In one aspect, this invention is directed to a process of confirming the targeting of a beam of X-radiation of from 4 to 25 MVp comprising (a) directing the X-radiation at a subject containing features that are identifiable by differing levels of X-radiation absorption and creating a first latent image of X-radiation penetrating the subject in a radiographic element, (b) placing a shield containing a portal between the subject and the source of X-radiation, directing X-radiation at the subject through the portal, and creating a second latent image superimposed on the first latent image in the radiographic element, (c) employing a processor to convert the latent images to viewable silver images from which intended targeting of the X-radiation passing through the portal in relation to the identifiable features of the subject is realized, the processor relying on attenuation of an infrared beam of a wavelength from 850 to 1100 nm by the radiographic element for activation, wherein (d) the radiographic element is comprised of a transparent film support having first and second major surfaces and, coated on each of the major surfaces, processing solution permeable hydrophilic colloid layers, at least one of said layers on each major surface including a light-sensitized silver halide grain population capable of providing a contrast in the range of from 4 to 8 and containing greater than 50 mole percent chloride and less than 3 mole percent iodide, based on silver, the total grain population being coated at a silver coverage of less than 30 mg/dm$^2$ and having a mean equivalent circular diameter of less than 0.6 $\mu$m, (e) during steps (a) and (b), total X-radiation exposure is limited to 10 seconds or less, at least one metal screen capable of emitting electrons when exposed to the X-radiation beam is interposed between the X-radiation beam and the radiographic element and at least one fluorescent intensifying screen is positioned to receive electrons from the metal screen and emit light to expose the radiographic element, (f) when introduced into the processor in step (c), the radiographic element containing in at least one of the hydrophilic colloid layers particles having an index of refraction in the wavelength range of from 850 to 1100 nm that differs from that of the hydrophilic colloid by at least 0.2 to create a specular density capable of attenuating the infrared beam and activating the processor, and (g) during step (c), the silver halide grain population is developed imagewise to produce the viewable silver images and undeveloped silver halide grains and the particles are removed from the radiographic element.

In another aspect this invention is directed to a portal localization radiographic element comprised of a transparent film support having first and second major surfaces and, coated on each of the major surfaces, processing solution permeable hydrophilic colloid layers, at least one of said hydrophilic colloid layers on each major surface including a light-sensitized silver halide grain population capable of providing a contrast in the range of from 4 to 8 and containing greater than 50 mole percent chloride and less than 3 mole percent iodide, based on silver, the total grain population being coated at a silver coverage of less than 30 mg/dm$^2$ and having a mean equivalent circular diameter of less than 0.6 $\mu$m, and, in at least one of the hydrophilic colloid layers, particles capable of being removed during processing to create a viewable image in the portal radiographic element and having an index of refraction in the wavelength range of from 850 to 1100 nm that differs from that of the hydrophilic colloid by at least 0.2.

DESCRIPTION OF PREFERRED EMBODIMENTS

A preferred localization portal imaging configuration according to the invention, Localization Assembly A, is schematically shown as follows:

| Assembly A |
|---|
| Metal Intensifying Screen (front) |
| Fluorescent Intensifying Screen (front) |
| Support |
| Fluorescent Layer |
| Portal Localization Radiographic Element |
| Imaging Unit (front) |
| Transparent Support |
| Imaging Unit (back) |
| Fluorescent Intensifying Screen (back) |
| Fluorescent Layer |
| Support |
| Metal Intensifying Screen (back) |

A portal localization radiographic element according to the invention is mounted between a pair of fluorescent intensifying screens. This sub-assembly is mounted between front and back metal intensifying screens. The various elements of the assembly are mounted in a cassette to hold the elements of the assembly in the desired relationship during X-radiation exposure and handling. The elements of the assembly are shown spaced apart for each of visualization, but, as mounted in a cassette, adjacent elements are pressed into direct contact.

Only one (front or back) metal intensifying screen and one (front or back) fluorescent screen are required. Specifically preferred alternative screen combinations include (i) the front metal intensifying screen and the front fluorescent screen and (ii) the front and back metal intensifying screens and one (front or back) fluorescent intensifying screen.

The front metal intensifying screen absorbs electrons that are generated by X-radiation absorption within the patient. X-radiation reaching the front and back metal intensifying screens stimulates electron emission. The electron emission from the metal intensifying screens stimulates light emission by the fluorescent intensifying screens that is principally responsible for latent image formation in the portal radiographic element.

During localization portal imaging the patient is briefly exposed to 4 to 25 MVp X-radiation over an area somewhat larger than the radiotherapy target area for the purpose of obtaining a discernible image of anatomy reference features outside the target area. This is immediately followed by a brief exposure through the port in the shields to create an image of the port superimposed on the broader area first exposure. Total exposure during localization imaging is limited to 10 seconds or less, typically from 1 to 10 seconds.

The object is to obtain an image that confirms or guides alignment of the port for radiotherapy, but to limit exposure to the MVp X-radiation to the extent possible. By seeing in the image the location of the port in relation to reference anatomy features, the port can be more accurately aligned with the target area, if necessary, before the longer duration radiotherapy exposure begins.

The twice exposed portal radiographic element must be processed to produce the viewable image of the port in relation to the anatomical reference features of the patient. For the localization image to have any value, the patient being examined and treated must, of course, remain immobile. Thus, rapid access processing offers significant value in reducing the period of immobility.

The portal radiographic elements of the invention are constructed to be capable of providing a contrast in the range of from 4 to 8. The high contrast is required to improve signal to noise and thereby render reference anatomical features more easily viewed in the image resulting from processing.

The elements are constructed in a dual-coated format to hold down hydrophilic colloid coverages per side and thereby facilitate rapid access processing. Since medical diagnoses are not contemplated to be undertaken from the portal image, the portal radiographic element can exhibit higher levels of crossover than are acceptable for medical diagnostic imaging. Crossover in excess of 30 percent is typically preferred and is essential when a single fluorescent intensifying screen is included in the exposure assembly.

High chloride silver halide emulsions are employed to facilitate rapid access processing. To make efficient use of silver, total silver coating coverages (i.e., the sum of silver coating coverages on the front and back sides of the support) of the light-sensitized grains is limited to less than 30 mg/dm$^2$. Total silver coating coverages of the light-sensitized grains are preferably at least about 15 mg/dm$^2$ and, most preferably, at least 20 mg/dm$^2$.

The combination of high chloride silver halide emulsions and total silver coating coverages of light-sensitized grains of less than 30 mg/dm$^2$ makes it difficult for the infrared sensor beams in rapid access processors to sense the presence of the portal radiographic element. To overcome this difficulty, the specular density of the portal radiographic elements to infrared radiation in the wavelength range of from rapid access processor infrared sensor beams (850 to 1 100 nm) is increased by the presence of particles dispersed in at least one of the hydrophilic colloid layers. The particles preferably have a mean ECD of from 0.3 to 1.1 (most preferably 0.5 to 0.9) $\mu$m and have an index of refraction at the wavelength of the infrared radiation that differs from the index of refraction of the hydrophilic colloid by at least 0.2, preferably at least 0.4. The higher the refractive index difference between the hydrophilic colloid and the particles, the larger the degree of near infrared scattering. Thus, there is no reason for intentionally limiting the refractive index difference. The particles are additionally chosen to be removable during rapid access processing, since they are no longer needed or desirable in the element after a silver image is developed in the element.

While the transparent support in its simplest form can consist of any flexible transparent film, it is common practice to modify the surfaces of radiographic film supports by providing subbing layers to promote the adhesion of hydrophilic colloids to the support. Any conventional radiographic film support can be employed. Radiographic film supports usually exhibit these specific features: (1) the film supports are constructed of polyesters to maximize dimensional integrity rather than employing cellulose acetate supports as are most commonly employed in photographic elements and (2) the film supports are blue tinted to contribute the cold (blue-black) image tone sought in the fully processed films. Colorless transparent film supports are also commonly used. Radiographic film supports, including the incorporated blue dyes that contribute to cold image tones, are described in *Research Disclosure*, Vol. 184, August 1979, Item 18431, Section XII. Film Supports. *Research Disclosure*, Vol. 389, September 1994, Item 38957, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthenate) are specifically preferred polyester film supports.

It is conceptually possible to construct each of the imaging units of a single hydrophilic colloid layer containing light-sensitized silver halide grains, with at least one of the hydrophilic colloid layers containing the particles for increasing specular density.

In practice it is usually preferred to construct the dual-coated portal radiographic element as illustrated by Element I:

| Element I |
|---|
| Surface Overcoat |
| Interlayer |
| Light-Sensitized Emulsion Layer(s) |
| Transparent Film Support |
| Light-Sensitized Emulsion Layer(s) |
| Interlayer |
| Surface Overcoat |

Each of the surface overcoat, interlayer and light-sensitized emulsion layer or layers forming an imaging unit contain a conventional hydrophilic colloid vehicle. The hydrophilic colloids and commonly associated addenda, such as hardeners, vehicle extenders, and the like, can be selected from among those disclosed by *Research Disclosure*, Item 38957, II. Vehicles, vehicle extenders, vehicle-like addenda and related addenda. Gelatin and gelatin derivatives, such as acetylated or phthalated gelatin, are specifically referred hydrophilic colloic vehicles. To facilitate rapid access processing the hydrophilic colloid is preferably fully forehardened. Useful hardeners are disclosed in Item 38957, Section II, cited above, B. Hardeners.

To facilitate processing in less than 90 seconds the fully forehardened hydrophilic colloid is coated on each side of the transparent support at a coating coverage of less than 65 mg/dm$^2$, as taught by Dickerson et al U.S. Pat. No. 4,900, 652, here incorporated by reference. Rapid access processing is less than 60 seconds, less than 45 seconds, and even less than 30 seconds are currently practiced in medical diagnostic imaging. Dickerson U.S. Pat. No. 5,576,156, here incorporated by reference, reports processing in less than 45 seconds by employing hydrophilic colloid coverages of less than 35 mg/dm$^2$ per side in a dual-coated element. While the Dickerson '156 preferred hydrophilic colloid coating coverages of 19 to 33 mg/dm$^2$ are fully applicable to this invention, it is apparent that the higher crossover levels of the portal radiographic elements of this invention allow the particulate crossover control dye of Dickerson '156 to be reduced or eliminated entirely, thereby allowing still lower hydrophilic colloid coating coverages to be employed, as demonstrated in the Examples below. Total hydrophilic colloid coating coverages per side as low as 10 mg/dM$^2$ are contemplated.

In at least one hydrophilic colloid layer on each side of the transparent support are incorporated light-sensitized silver halide grains to form light-sensitized emulsion layers. To facilitate rapid access processing the grains contain less than 3 mole percent iodide, based on silver. The grains contain greater than 50 mole percent chloride, based on silver. Any remaining halide can be bromide. Thus, the light-sensitized silver halide grains can take any of the following compositions: silver chloride, silver iodochloride, silver bromochloride, silver bromoiodochloride or silver iodobromochloride. In an optimum balance of developability, covering power and image tone, the light-sensitized silver halide grains contain from 20 to 40 mole percent bromide, based on silver. Silver bromochloride emulsions are specifically preferred.

The silver halide grains are light-sensitized. That is, they are in all instances chemically sensitized. Conventional chemical sensitization of silver halide grains is disclosed by *Research Disclosure*, Item 38957, IV. Chemical sensitization. Preferably the grains are sulfur and gold sensitized.

The high chloride grains must also be capable of responding to light of the wavelengths principally emitted by at least one fluorescent screen. Such emissions can be in the ultraviolet—a spectral region in which high chloride grains possess significant native sensitivity. However, in most instances fluorescent screens emit principally in the visible region of the electromagnetic spectrum, where high chloride grains exhibit little native sensitivity. Therefore, in most instances the light-sensitized silver halide grains additionally include one or more spectral sensitizing dyes adsorbed to the grain surfaces. Spectral sensitizing dyes useful in imparting sensitivity to the silver halide grains within the principal emission wavelength ranges of fluorescent screens are disclosed by *Research Disclosure*, Item 38957, V. Spectral sensitization and desensitization, A. Sensitizing dyes, and *Research Disclosure*, Item 1843 1, cited above, X. Spectral Sensitization.

Although the high chloride grains must be light-sensitized to be useful for localization imaging, unlike medical diagnostic radiography, grains having the highest attainable levels of light sensitivity are not suitable. The requirement of high chloride grains in itself contributes to controlling their light sensitivity, since silver bromide grains containing low levels of iodide are known to be capable of attaining the highest levels of light sensitivity. The light sensitivity of the grains is also controlled by limiting the mean ECD of the grains to less than 0.6 $\mu$m. An optimum grain size for localization portal imaging in the range of from about 0 to 0.4 $\mu$m.

To achieve high levels of contrast, within the contemplated range of from 4 to 8, it is contemplated to employ a light-sensitized grain population having a grain size coefficient of variation of less than 20 percent, optimally less than 10 percent. The lowest attainable grain size COV's are preferred. Generally regular grains, those lacking internal stacking faults (e.g., twin planes and screw dislocations) are most readily prepared having low levels of grain size dispersity. Cubic and tetradecahedral high chloride grains are specifically preferred.

In addition to controlling grain size dispersity, the contrast of the portal radiographic elements are contemplated to be raised by the incorporation of one or more contrast enhancing dopants in the light-sensitized grains. Rhodium, cadmium, lead and bismuth are all well known to increase contrast by restraining toe development. The toxicity of cadmium has precluded its continued use. Rhodium is most commonly employed to increase contrast and is specifically preferred. Contrast enhancing concentrations are known to range from as low $10^{-9}$ mole/Ag mole. Rhodium concentrations up to $5\times10^{-3}$ mole/Ag mole are specifically contemplated. A specifically preferred rhodium doping level is from $1\times10^{-6}$ to $1\times10^{-4}$ mole/Ag mole.

A variety of other dopants are known, individually and in combination, to improve not only contrast, but other common properties, such as speed and reciprocity characteristics. Iridium dopants are very commonly employed to decrease reciprocity failure. The extended exposure times of the portal radiographic elements of the invention render it highly desirable to include one or more dopants to guard against low intensity reciprocity failure, commonly referred to as LIRF. Kim U.S. Pat. No. 4,997,751, here incorporated by reference, provides a specific illustration of Ir doping to reduce LIRF. A summary of conventional dopants to improve speed, reciprocity and other imaging characteristics is provided by *Research Disclosure*, Item 38957, cited above, Section I. Emulsion grains and their preparation, sub-section D. Grain modifying conditions and adjustments, paragraphs (3), (4) and (5).

The low COV emulsions of the invention can be selected from among those prepared by conventional batch double-jet precipitation techniques. The emulsions can be prepared, for example, by incorporating a rhodium dopant during the precipitation of monodispersed emulsions of the type commonly employed in photographic reflection print elements. Specific examples of these emulsions are provided by Hasebe et al U.S. Pat. No. 4,865,962, Suzumoto et al U.S. Pat. No. 5,252,454, and Oshima et al U.S. Pat. No. 5,252,456, the disclosures of which are here incorporated by reference. A general summary of silver halide emulsions and their preparation is provided by *Research Disclosure*, Item 38957, cited above, I. Emulsion grains and their preparation.

Due to their low coating density (<30 mg/dm$^2$ total Ag) as well as their high chloride content and limited mean ECD's, the light-sensitized grains have a limited capability of scattering near infrared radiation within the 850 to 1100 nm range normally used by rapid access processor internal film sensors. To augment the specular density of the portal radiographic elements to near infrared radiation within the indicated sensor range particles having a refractive index differing from that of the hydrophilic colloid by at least 0.2 are additionally included in at least one hydrophilic colloid layer, minimally, in a single hydrophilic colloid layer on one side of the support, but preferably in one hydrophilic colloid layer on each side of the support.

To avoid any unintended interaction of the particles with the light-sensitized silver halide grains, the particles are preferably located in one or more hydrophilic colloid layers other than those that contain the light-sensitized grains. The particles are ideally located in a hydrophilic colloid layer that receives light from a fluorescent screen subsequent to the passing through an emulsion layer, since this minimizes light scattering during imagewise exposure of the light-sensitized grains. However, since reductions in image sharpness that would be objectionable to medical diagnostic imaging are tolerable for localization portal imaging, the particles are not restricted in location to any particular hydrophilic colloid layer or layers.

In addition to being chosen to have an index of refraction differing from that of the hydrophilic colloid in which they are suspended by at least 0.2, as indicated above, the particles are chosen (a) to be removable from the portal radiographic element during processing and (b) to have a mean size of from 0.2 to 1.9 μm, preferably 0.3 to 1.1 μm. The optimum mean particle size for scattering near infrared radiation in the sensor wavelength range is approximately 0.7 μm; therefore a specifically preferred size range is from 0.5 to 0.9 μm. When the particles are compact (i.e., have an average aspect ratio of <2.0), they are more or less randomly oriented in the layer or layers in which they are incorporated and hence scatter infrared radiation more efficiently than highly asymmetric particles, such as tabular grains, that orient themselves with a major crystal face parallel to the film support.

A wide variety of materials are known that can be prepared in the indicated particle size range and exhibit refractive indices that differ from that of the vehicle present in the hydrophilic colloid layer. Of these materials, those that are removable during processing following imagewise exposure are specifically selected. Even if the particles are sufficiently stable to remain permanently unaltered in the processed film, the image bearing element has a hazy appearance, which degrades and may obscure the images obtained. A simple illustration of haze is provided by placing a newspaper behind an imaged film and attempting to read the text through the film. The newsprint can be read through a film exhibiting low haze, but can be read, if at all, only with difficulty through a hazy film.

In one form the particles are comprised of silver halide. Since the particles are not employed for latent image formation, they are neither chemically nor spectrally sensitized. The silver halide particles can be chosen from among any of the silver halide compositions disclosed above in connection with the light-sensitized grains. As in the case of the grains, iodide in the silver halide particles is limited to 3 (preferably 1) mole percent or less, based on silver, to facilitate removal of the particles by fixing during rapid access processing. If the silver halide particles remain in the element after processing, they may printout when the element is placed on a light box for viewing, thereby objectionably raising minimum density. Since there is no advantage to iodide inclusion in the particles, it is specifically preferred that it be entirely eliminated or present in only impurity concentrations.

If very rapid processing is contemplated, requiring high chloride silver halide radiation-sensitive grains, then the elements can also benefit by choosing high chloride silver halide particles. However, there is a higher mismatch between hydrophilic colloid and silver bromide refractive indices, making particles of the latter more efficient in scattering near infrared radiation. Since the inclusion of iodide in concentrations compatible with rapid access processing does not increase the mismatch of the refractive indices, it is preferred to employ iodide-free high bromide (most preferably silver bromide) particles.

Instead of employing silver halide particles, other silver salts known to be alternatives to silver halide can be employed in combination with or in place of silver halide to fonn the particles. Other useful silver salts for fonning particles can be chosen from among silver salts such as silver thiocyanate, silver phosphate, silver cyanide, silver citrate and silver carbonate. The compatibility of these silver salts with silver halide emulsions and processing is illustrated by Berriman U.S. Pat. No. 3,367,778, Maskasky U.S. Pat. Nos. 4,435,501, 4,463,087, 4,471,050 and 5,061,617, Ikeda et al U.S. Pat. No. 4,921,784, Brust et al U.S. Pat. No. 5,395,746 and *Research Disclosure*, Vol. 181, May 1979, Item 18153. These silver salt containing particles have the advantages of being (a) readily available, (b) environmentally acceptable, (c) chemically stable, and (d) compatible with silver halide imaging. There are, of course, a wide variety of other particle materials that can be substituted, but with some reduction of one or more of advantageous characteristics (a) through (d). There is, of course, no reason to employ materials, such as organic dyes or pigments, that are comparatively expensive or burdensome to prepare.

Any threshold amount of the particles that detectably increase specular density to near infrared radiation in the 850 to 1100 nm wavelength range can be employed. The amount required to raise the specular density of the element to the level of detectability by processor sensors will vary, depending on the level of specular density which the light-sensitized grains provide. In all instances the combined total silver coating coverage of the light-sensitized grains and particles remains less than 30 mg/dm$^2$. Since the particles can be selected by composition, size and shape to enhance the specular density of the portal radiographic element, it is appreciated that portal radiographic elements according to the invention can be constructed with total silver coating coverages well below 30 mg/dm$^2$.

A convenient location for placing the particles is in the surface overcoat or interlayer overlying the emulsion layer or layers. Placement of the particles on both sides of the support in layers near the surface of the portal radiographic element facilitates removal of the particles during rapid access processing.

The surface overcoat and interlayer contain hydrophilic colloid, described above, as a vehicle. A primary function of the surface overcoat is to provide physical protection for the underlying emulsion layer(s). Other conventional components are disclosed in *Research Disclosure*, Item 18431, cited above, III. Antistatic Agents/Layers and IV. Overcoat Layers and *Research Disclosure*, Item 38957, cited above, IX. Coating physical property and modifying addenda, A. Coating aids, B. Plasticizers and lubricants, C. Antistatis and D. Matting agents. The interlayer can be omitted, but is usually included to provide a thin layer of separation between the addenda of the surface overcoat and the next adjacent emulsion layer. Addenda, that do not interact with emulsion layer components, such as matting agents, are often placed in the interlayer. Thus, placement of specular density increasing particles in the interlayers is specifically contemplated.

Other conventional addenda can be placed in the portal radiographic elements of the invention, if desired. For example, instability that increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 1843 1, Section II. Emulsion Stabilizers, Antifoggants and Antikinking Agents.

The fluorescent intensifying screens can take any convenient conventional form. High resolution fluorescent intensifying screens, such as, for example, those employed in mammography, are unnecessary, since the object is simply to provide images with identifiable anatomical features, not the fine detail required for diagnostics. Since resolution detail is not required the fluorescent layers can conveniently take any of the forms of those found in intermediate to high speed fluorescent intensifying screens. Typically the fluorescent intensifying screens contain a reflective or transparent film support, preferably the former. If a transparent support is employed in Assembly A above, reflection of light from the back metal intensifying screen can be used to increase the amount of light transmitted to the portal radiographic element. If a reflective (e.g., white) support is incorporated in the fluorescent intensifying screen, even a higher proportion of emitted light will reach the portal radiographic element. Examples of conventional, useful fluorescent intensifying screens are provided by *Research Disclosure*, Item 1843 1, cited above, Section IX. X-Ray Screens/Phosphors, and Bunch et al U.S. Pat. No. 5,021,327 and Dickerson et al U.S. Pat. Nos. 4,994,355, 4,997,750, and 5,108,881, the disclosures of which are here incorporated by reference. The fluorescent layer contains phosphor particles and a binder, optimally additionally containing a light scattering material, such as titania. Higher emission efficiencies are realized with phosphors such as calcium tungstate ($CaWO_4$) niobium and/or rare earth activated yttrium, lutetium or gadolinium tantalates, and rare earth activated rare earth oxychalcogenides and halides.

The rare earth oxychalcogenide and halide phosphors are preferably chosen from among those of the following formula:

$$M_{(w-n)}M'_nO_wX \quad (I)$$

wherein

M is at least one of the metals yttrium, lanthanum, gadolinium or lutetium,

M' is at least of the rare earth metals, preferably dysprosium, erbium, europium, holmium, neodymium, praseodymium, samarium, terbium, thulium, or ytterbium, X is a middle chalcogen (S, Se or Te) or halogen, n is 0.002 to 0.2, and w is 1 when X is halogen or 2 when X is chalcogen.

The metal intensifying screens can take any convenient conventional form. While the metal intensifying screens can be formed of many different types of materials, the use of metals is most common, since metals are most easily fabricated as thin foils, often mounted on radiation transparent backings to facilitate handling. Convenient metals for screen fabrication are in the atomic number range of from 22 (titanium) to 82 (lead). Metals such as copper, lead, tungsten, iron and tantalum have been most commonly used for screen fabrication with lead and copper in that order being the most commonly employed metals.

The metal foils typically range from 0.1 to 2 mm in thickness when employed as a front screen. A preferred front screen thickness range for lead is from about 0.1 to 1 mm and for copper from 0.25 to 2 mm. Generally the higher the atomic number, the higher the density of the metal and the greater its ability to absorb MVp X-radiation.

The back metal intensifying screens can be constructed of the same materials as the front intensifying screens. In the case of the back metal intensifying screen, the only advantage to be gained by limiting their thickness is reduction in overall cassette weight. Since a back metal intensifying screen is not essential, there obviously is no minimum essential thickness, but typically the back metal intensifying screen is at least as thick as the front metal intensifying screen with which it is used when both are of the same composition. Generally the thickness of the back metal intensifying screen is determined on the basis of convenience of fabrication and handling and the weight it adds to the cassette assembly.

Instead of employing separate metal and fluorescent intensifying screens, it is possible to integrate both functions into a single element by coating a fluorescent layer onto one or both of the metal intensifying screens.

Rapid access processing can be illustrated by reference to the Kodak X-OMAT M6A-N ™ rapid access processor, which employs the following processing cycle (hereinafter referred to as Reference 1):

| | |
|---|---|
| development | 24 seconds at 35° C. |
| fixing | 20 seconds at 35° C. |
| washing | 20 seconds at 35° C. |
| drying | 20 seconds at 65° C. |

with less than 6 seconds being taken up in film transport between processing steps.

A typical developer employed in this processor exhibits the following composition:

| | |
|---|---|
| hydroquinone | 30 g |
| 1-phenyl-3-pyrazolidone | 1.5 g |
| KOH | 21 g |
| $NaHCO_3$ | 7.5 g |
| $K_2SO_3$ | 44.2 g |
| $Na_2S_2O_3$ | 12.6 g |
| NaBr | 35.0 g |
| 5-methylbenzotriazole | 0.06 g |
| glutaraldehyde | 4.9 g |
| water to 1 liter at a pH 10.0 | |

A typical fixer employed in this processor exhibits the following composition:

| | |
|---|---|
| $Na_2S_2O_3$ in water at 60% of total weight in water | 260.0 g |
| $NaHSO_3$ | 180.0 g |
| boric acid | 25.0 g |
| acetic acid | 10.0 g |
| water to 1 liter at a pH of 3.9–4.5. | |

Numerous variations of the reference processing cycle (including, shorter processing times and varied developer and fixer compositions) are known. For example, Dickerson U.S. Pat. No. 5,576,156 discloses a Kodak X-Omat RA 480 rapid access processor set for the following process cycle:

| | |
|---|---|
| development | 11.1 seconds at 40° C. |
| fixing | 9.4 seconds at 30° C. |
| washing | 7.6 seconds at room temperature |
| drying | 12.2 seconds at 67.5° C. |

employing the following developer:

| | |
|---|---|
| hydroquinone | 32 g |
| 4-hydroxymethyl-4-methyl-1-phenyl-3-pyrazolidone | 6 g |
| KBr | 2.25 g |
| $Na_2S_2O_3$ | 160 g |
| 5-methylbenzotriazole | 0.125 g |
| water to 1 liter at a pH 10.0. | |

Rapid access processors are typically activated when an imagewise exposed element is introduced for processing. Silver halide grains in the element interrupt an infrared sensor beam in the wavelength range of from 850 to 1100 nm, typically generated by a photodiode. The silver halide grains reduce density of infrared radiation reaching a photosensor, telling the processor that an element has been introduced for processing and starting the rapid access processing cycle. Once silver halide grains have been developed, developed silver provides the optical density necessary to interact with the infrared sensors. A further description of sensor control of a rapid access processor is provided by Harada et al U.S. Pat. No. 5,260,178, cited above and here incorporated by reference.

EXAMPLES

The invention can be better appreciated by reference to the following specific embodiments. In the examples all coating coverages are in units of mg/dm$^2$, except as otherwise indicated.

Example 1

The following radiographic elements were constructed for comparison of imaging performance in localization portal imaging.

The elements were constructed to demonstrate the advantages of the invention which are independent of the specular density increasing particles. A portal localization imaging element according to Sephton U.S. Pat. No. 4,868,399 and a dual-coated medical diagnostic radiographic element were chosen for comparison as representative of the current state of the art.

All elements employed a blue tinted poly(ethylene terephthalate) film support having a thickness of 178 $\mu$m. All of the hydrophilic colloid layers were hardened with bis (vinylsulfonylmethyl)ether, at a level of 2.4 percent by weight, based on total weight of gelatin.

PRE-1A (invention)

A portal radiographic element exhibiting a crossover of 40% and an average contrast of >4.0 satisfying the requirements of the invention was constructed to have the following structure:

| (PRE-1A) |
|---|
| SURFACE OVERCOAT |
| INTERLAYER |
| EMULSION LAYER |
| SUPPORT |
| EMULSION LAYER |
| INTERLAYER |
| SURFACE OVERCOAT |

| Surface Overcoat | Coverage |
|---|---|
| Gelatin | 3.4 |
| Methyl methacrylate (matte beads) | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

-continued (PRE-1A)

| Interlayer | Coverage |
|---|---|
| Gelatin | 3.4 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |

| Emulsion Layer | Coverage |
|---|---|
| $AgBr_{30}Cl_{70}$ (ECD 0.34 $\mu$m, Rh doped) (sulfur and gold sensitized) | 18.3 |
| Gelatin | 21.5 |
| Antifoggant-1 | 2.1 g/Ag mole |
| Sensitizing Dye-1 | 0.35 |
| Sensitizing Dye-2 | 1.41 |
| Surfactant | 1.7 |
| Hydroquinone | 0.47 |
| Latex Polymer-1 | 1.28 |
| APMT | 0.006 |
| Chelating Agent-1 | 0.11 |

Rh doped $6.9\times10^{-5}$ gram atoms Rh per Ag mole

Antifoggant-1

2-Carboxy-4-hydroxy-6-methyl-1,3,3A,7-tetraazaindene

Sensitizing Dye-1

3-Carboxymethyl-5-[(3-methyl-2(3H)-thiazolin-ylidene) isopropylidene]rhodanine

Sensitizing Dye-2

3-Ethyl-5-[1-(4-sulfobutyl)-4(1H)-pyridyliene)rhodanine

Latex Polymer-1

Poly(methyl acrylate-co-2-acrylamido-2-methylpropane sullonic acid, sodium salt-co-2-acetoacetoethyl methacrylate) (89.6:3.7:6.7 wt. ratio)

AMPT 1-(3-Acetamidophenyl)-5-mercaptotetrazole

Chelating Agent-1

Ethylenediaminetetraacetic acid, disodium salt

PRE-1S (a control)

This portal radiographic element was constructed identically to the Kodaline 2586™ graphic arts film employed by Sephton U.S. Pat. No. 4,868,399, except that the blue tinted support described above was employed to facilitate comparability and transport through the rapid access processor. The film exhibited the following structure:

| (PRE-1S) |
|---|
| SURFACE OVERCOAT |
| INTERLAYER |
| EMULSION LAYER |
| SUPPORT |
| PELLOID LAYER |
| INTERLAYER |
| SURFACE OVERCOAT |

(PRE-IS)

The surface overcoat and interlayers were identical to those of PRE-1A. The single emulsion layer contained the sum of the ingredients of the two emulsion layers of PRE-1A. The pelloid layer exhibited the following structure:

| Pelloid Layer | Coverage |
|---|---|
| Gelatin | 48.0 |
| Dye-3 | 0.24 |
| Dye-4 | 0.37 |
| Dye-5 | 0.13 |

Dye-3

Bis[3-methyl-1-(p-sulfophenyl)-2-pyrazolin-5-one-(4H] methineoxonol

Dye-4

4-[4-(N,N-dimethylamino)phenyltrimethine]-3-methyl-1-p-sulfophenylpyrazolin-5-one-(4H) triethylamine (a.k.a. acid violet)

Dye-5

Bis[3-methyl-1-(p-sulfophenyl)-2-pyrazolin-5-one-(4H)] pentamethineoxonol

PRE-1C (a control)

A conventional dual-coated diagnostic radiographic element having a crossover of 24% was provided for comparison. The diagnostic radiographic element exhibited the same overall layer arrangement as PRE-1A. The surface overcoats and interlayers were identical to those of PRE-1A. The composition of the emulsion layer is shown below:

| Emulsion Layer | Coverage |
|---|---|
| AgBr T-Grains ™ | 22.0 |
| Gelatin | 32.0 |
| Antifoggant-1 | 2.1 |
| | g/Ag mole |
| Potassium nitrate | 1.8 |
| Ammonium hexachloropalladate | 0.0022 |
| Sorbitol | 0.53 |
| Glycerin | 0.57 |
| Potassium bromide | 0.14 |
| Resorcinol | 0.44 |

AgBr T-Grains™

This was a spectrally sensitized emulsion of the type disclosed by Abbott et al U.S. Pat. No. 4,425,425. That is, the silver bromide grains were high aspect ratio tabular grains. Greater than 50 percent of total grain projected area was accounted for by tabular grains having an average thickness of 0.13 $\mu$m and an average ECD of 2.0 $\mu$m. The emulsion was sulfur and gold chemically sensitized and spectrally sensitized with 400 mg/Ag mole of anhydro-5,5'-dichloro-9-ethyl-3,3'-bis(3-sulfopropyl)oxacarbocyanine hydroxide, followed by the addition of 300 mg/Ag mole of potassium iodide.

Cassette Assemblies

The following screen-cassette were assembled for comparison of localization portal imaging capabilities of varied films:

Cassette L

This cassette was chosen to illustrate a conventional cassette of the type presently used in localization portal imaging. Its intensifying screens consisted of a 1.0 mm copper front screen and a 0.25 mm lead back screen.

Cassette L1S

This cassette was similar to Cassette L, except that the back lead screen was replaced by a fluorescent intensifying screen, Screen W, described below.

Screen W

This fluorescent intensifying screen is commercially available as Lanex™ fast back. It consists of a terbium activated gadolinium oxysulfide phosphor having a median particle size of 7 $\mu$m coated on a white pigmented poly (ethylene terephthalate) film support in a Permuthane™ polyurethane binder at a total phosphor coverage of 13.3 g/dm$^2$ at a phosphor to binder ratio of 19:1.

Performance

The imaging performance of the radiographic elements in the cassettes is summarized below in Table I.

TABLE I

| Assembly | Rel. Speed | $\gamma$ | % XO | % Dryer | Artifacts |
|---|---|---|---|---|---|
| PRE-1C/L | 100 | 1.6 | NR | 70% | Low |
| PRE-1C/L1S | 13,200 | 2.3 | 24 | 70% | Low |
| PRE-1S/L1S | 29 | 5.3 | NR | >100% | High |
| PRE-1A/L1S | 45 | 4.6 | 40 | 40% | Low |

When the conventional dual-coated diagnostic radiographic element PRE-1C was mounted in Cassette L between copper and lead intensifying screens, given an exposure to MVp X-radiation representative of localization portal imaging, and processed using a rapid access processor, a low contrast image was obtained that provided a poor definition of simulated anatomical features. The film was processable in less than 45 seconds and exhibited a low noticeability of artifacts in the final image, which necessarily followed from its poor definition of anatomical features. Crossover was not relevant (NR), since the metal intensifying screens did not emit light.

When a fluorescent intensifying screen was added to the assembly, replacing the back lead intensifying screen, the speed of the assembly became excessively high. This high level of speed was incompatible with using the film for localization portal imaging. Thus, diagnostic radiographic element PRE-1C had utility for only localization portal imaging with metal intensifying screens.

When PRE-1S was substituted for PRE-1C in Cassette L1S, improved contrast was observed, but the film could not be processed in less than 45 seconds. It passed through the processor without being fully dried, which is the result of the excessively high coating of hydrophilic colloid on one side of the support and this in turn being a function of the silver coated on the one side of the support. Artifacts were quite noticeable in processed film. This demonstrates the incompatibility of the Sephton approach to localization portal imaging using rapid access processing techniques. Further, the prominence of artifacts in the images was objectionable.

When the localization portal imaging radiographic element of the invention, PRE-1A, was substituted for the PRE-1S radiographic element, improved imaging characteristics were obtained and the radiographic element required only 40 percent of the drying cycle in the rapid access processor to be fully dried. Thus, taking imaging properties (e.g. contrast and the observability of anatomical features), the relatively low visibility of artifacts, and the rapid access processing capability, PRE-1S, satisfying the requirements of the invention, exhibited overall properties superior to those of either the diagnostic radiographic element or the Sephton localization portal radiographic element. A further advantage of PRE-1A over PRE-1S is that the latter contained a dyed pelloid layer requiring operator care in orienting the radiographic element for imaging, whereas PRE-1A has identical front and back imaging unit coatings and hence entirely obviates any need for front and back side orientations during cassette assembly.

In Table II below the comparative performance of control PRE-1S and invention PRE-1A using one (L1S) or two (L2S) fluorescent intensifying screens is shown.

TABLE II

| Assembly | Rel. Speed | γ |
|---|---|---|
| PRE-1S/L1S | 34 | 5.3 |
| PRE-1S/L2S | 37 | 5.5 |
| PRE-1A/L1S | 45 | 4.5 |
| PRE-1A/L2S | 78 | 7.8 |

From Table II it can be seen that radiographic element PRE-1A, satisfying the requirements of the invention, demonstrated an additional speed gain and contrast enhancement when a second fluorescent intensifying screen was added, whereas the performance of PRE-1S remained essentially similar, with one or two fluorescent intensifying screens mounted in the cassette.

Rapid access processing of film samples was accomplished using a Kodak 480 RA X-Omat™ processor adjusted for the following processing cycle:

| | |
|---|---|
| Development | 11.1 sec., 37° C. |
| Fixing | 9.4 sec., 35° C. |
| Wash | 7.6 sec., 35° C. |
| Drying | 12.2 sec., 60° C. |
| Total time | 40.3 sec. |

The developer composition was as follows:

| Component | g/L |
|---|---|
| Hydroquinone | 32.0 |
| 4-Hydroxymethyl-4-methyl-1-phenyl-pyrazolidone | 6.0 |
| Potassium bromide | 2.25 |
| 5-Methylbenzotriazole | 0.125 |
| Sodium sulfite | 160.0 |
| pH 10.35 | |
| Water to 1 L | |

The fixer composition was as follows:

| Component | g/L |
|---|---|
| Ammonium thiosulfate | 131.0 |
| Sodium thiosulfate | 15.0 |
| Sodium bisulfate | 180.0 |
| Boric acid | 25.0 |

-continued

| Component | g/L |
|---|---|
| Acetic acid | 10.0 |
| pH 4.9 | |
| Water to 1 L | |

Percent drying in Table I was determined by feeding an exposed film sample flashed to result in an density of 1.0 into the rapid access processor. As the film just began to exit the processor, the processor was stopped and the film was removed from the processor for examination. On wet portions of the film roller marks are visible. A 100% dryer rating indicates that the film had not dried. That is, roller marks were observed on the portion of the film exiting the processor. When the film dried within the processor, the percentage of the dryer rollers the film had to traverse before roller marks on the film disappeared is noted as % dryer.

Crossover was measured according to the procedure described by Abbott et al U.S. Pat. No. 4,425,425.

Relative speeds in this example were measured by placing the indicated film/cassette combination beneath a 10 cm stack of acrylic plastic slabs and irradiating with 6 MVp X-radiation from a Varian Clinac 1800™ therapy X-ray machine. The X-ray beam incident to the acrylic slab stack was 24.5×24.5 cm in size. For each cassette/film combination a series of film samples were exposed with the X-Ray machine's Monitor unit setting (relative exposure) being adjusted by a factor of two for each successive film exposure. After processing as described above, diffuse transmission visual optical densities of all films were measured with an X-rite Model 310™ photographic densitometer having a 3 mm diameter measuring aperture. From a graph of the measured optical densities versus the relative exposures, in monitor units, the number of monitor units required to produce an optical density of 1.0 above base+fog density was detennined for each film/cassette combination. The reciprocal of the monitor units thus determined were then multiplied by a constant to give a relative speed of 100 for the PRE-1C/L film-cassette assembly, which is commonly used for localization portal imaging. The speed of the PRE-1C/L1S film-cassette assembly was estimated. The lowest possible exposure (1.0 Monitor unit) from the X-Ray machine produced an optical density of 3.72, which is near the film's maximum density. Thus this film-cassette combination was much too fast for use in the X-ray machine. For the Table II relative speeds the multiplication constant was chosen to provide a relative speed of 34 for the PRE-1S/L1S film-screen combination.

Values of average gradient for the films exposed to light from the fluorescent intensifying screen W were determined using an automated intensity scale (inverse square law) X-ray sensitometer device. With this device, each film, while in contact with a single Screen W, was given a sequential stepped series of 26 X-ray exposure levels with 0.10 $\log_{10}$ exposure increments. The X-ray exposure time for each exposure was 3.0 seconds. The X-ray intensity, and hence the fluorescent screen brightness, was adjusted to give the required exposure steps by changing the distance from the film-cassette assembly to the X-ray tube focal spot. The inverse square of the distance was used as a measure of relative exposure. After each exposure the film-cassette assembly was translated behind an aperture in a lead plate mounted to intercept the X-ray beam to present a new unexposed region of film for the next exposure step in the series. The X-ray tube had a tungsten target and was operated at 80 kVcp (constant potential). The X-ray beam was filtered by a 0.5 mm thick copper plate plus a 2.0 mm thick aluminum plate. The average gradient of the film-cassette assembly PRE-1C/L exposed directly to ionizing radiation, as opposed to light from a fluorescent intensifying screen, was obtained from time scale sensitometry done with a X-Ray beam from a tungsten target X-Ray tube operated at 320 kVcp. The X-Ray beam was filtered by a 11.6 mm thick copper plate. The film was exposed while in a cassette having a 0.13 mm front lead intensifying screen and a 0.25 mm back lead intensifying screen. The cassette was translated in a step-wise fashion behind an aperture in a lead plate placed in the X-ray beam at a distance of 1.0 m from the X-ray tube target. A total of 21 exposure levels, in 0.15 $\log_{10}$ exposure increments, were given to the film by varying the exposure times as required from 1.0 to 1000 seconds. After the films were processed as described above, the relative exposure values required for the average contrast calculation were determined from graphs of the film optical density, measured as described above, plotted versus the $\log_{10}$ relative exposure.

Example 2

This example has as its purpose to demonstrate that the inclusion of unsensitized silver bromide grains as specular density increasing particles is capable of producing density increases in the 850 to 100 nm range of infrared sensors sufficient to allow reliable sensing of the portal localization imaging elements of the invention, and the particles have no measurable influence on imaging characteristics.

PRE-IV (control)

The layer arrangement of Element I, described above, was employed:

| |
|---|
| Surface Overcoat |
| Interlayer |
| Light-Sensitized Emulsion Layer |
| Transparent Film Support |
| Light-Sensitized Emulsion Layer |
| Interlayer |
| Surface Overcoat |

Transparent Film Support

A blue tinted transparent poly(ethylene terephalate) film support having a thickness of 178 $\mu$m was employed.

Surface Overcoat

Identical to PRE-1A

Interlayer

Identical to PRE-1A

| Light-Sensitized Emulsion Layer | Coverage |
|---|---|
| $AgBr_{30}Cl_{70}$(0.34 $\mu$m ECD, Rh doped) (sulfur and gold sensitized) | 11.5 |
| Gelatin | 24.2 |
| 5-Bromo-4-hydroxy-6-methyl-1,3,3A,7-tetraazaindene | 200 mg/Ag mole |
| 5-Carboxy-4-hydroxy-6-methyl-2-methyl-mercapto-1,3,3A,7-tetraazaindene | 0.043 |

-continued

| Light-Sensitized Emulsion Layer | Coverage |
|---|---|
| Sensitizing Dye-3 | 300 mg/Ag mole |
| Bis(vinylsulfonylmethyl)ether | 2.4%, by wt, based on weight of gelatin |

Sensitizing Dye-3

Anhydro-5-Chloro-3-ethyl-1-(2-hydroxyethyl)-3-methyl-1'-(3-sulfo-n-butyl)-6,6'-di(trifluoromethyl) benzimidazolo carbocyanine hydroxide

PRE-V (invention)

This radiographic element was constructed identically to Radiographic Element A above, except that 3.2 mg/dm$^2$ of an unsensitized (no chemical or spectral sensitizer) silver bromide cubic grains having a mean ECD of 0.8 $\mu$m was added to each interlayer.

Exposure

Each radiographic element was mounted in a cassette between a pair of fluorescent screens, described above as Screen W.

The screen-film assemblies were exposed for 12 seconds to 70 KVp X-radiation using a 3-phase Picker Medical (Modeal VTX-650)™ X-ray unit containing filtration up to 3 mm of aluminum. Sensitometric gradations in exposure were achieved using a 21 increment (0.1 log E) aluminum step wedge of varying thickness. Although lower energy X-radiation was used to stimulate the fluorescent screens, the light emissions from the fluorescent screens to PRE-IV and PRE-V were comparable to those obtainable using higher energy X-radiation to expose intermediate metal intensifying screens to stimulate the fluorescent screens.

Rapid Access Processing

The Reference 1 rapid access processing cycle, described above, was employed.

Sensitometric Results

Both PRE-IV (control) and PRE-V (invention) exhibited the same toe and mid-scale speeds and contrast. Toe speed was measured at a density of 0.25 above minimum density. Mid-scale speed was measured at a density of 1.00 above minimum density. Density was measured using an X-rite Model 310™ densitometer calibrated according to ANSI standard pH 2.19.

Prior to processing the specular density of the PRE-IV and PRE-V were measured at 940 nm. Control PRE-IV, exhibited a density of only 0.31, whereas the invention element PRE-V exhibited a density of 0.93. The infrared specular density of PRE-V was above the 0.8 minimum level and preferred minimum 0.9 level to assure reliable detection by infrared sensors in the rapid access processor.

The invention has been described in detail with particular reference to preferred embodiments thereof, but it will be understood that variations and modifications can be effected within the spirit and scope of the invention.

What is claimed is:

1. A process of confirming the targeting of a beam of X-radiation of from 4 to 25 MVp comprised of (a) directing the X-radiation at a subject containing features that are identifiable by differing levels of X-radiation absorption and creating a first latent image of X-radiation penetrating the subject in a radiographic element, (b) placing a shield containing a portal between the subject and the source of X-radiation, directing X-radiation at the subject through the portal, and creating a second latent image superimposed on the first latent image in the radiographic element, (c) employing a processor to convert the latent images to viewable silver images from. which intended targeting of the X-radiation passing through the portal in relation to the identifiable features of the subject is realized, the processor relying on attenuation of an infrared beam of a wavelength from 850 to 1100 nm by the radiographic element for activation,

WHEREIN (d) the radiographic element is comprised of a transparent film support having first and second major surfaces and, coated on each of the major surfaces, processing solution permeable hydrophilic colloid layers, at least one of said layers on each major surface including a light-sensitized silver halide grain population capable of providing a contrast in the range of from 4 to 8 and containing greater than 50 mole percent chloride and less than 3 mole percent iodide, based on silver, the total grain population being coated at a silver coverage of less than 30 mgidm$^2$ and having a mean equivalent circular diameter of less than 0.6 $\mu$m, (e) during steps (a) and (b), total X-radiation exposure is limited to 10 seconds or less, at least one metal screen capable of emitting electrons when exposed to the X-radiation beam is interposed between the X-radiation beam and the radiographic element and at least one fluorescent intensifying screen is positioned to receive electrons from the metal screen and emit light to expose the radiographic element, (f) when introduced into the processor in step (c), the radiographic element of (d) further contains, in at least one of the hydrophilic colloid layers, high bromide silver halide particles containing less than 3 mole percent iodide, based of silver, and having an index of refraction in the wavelength range of from 850 to 1100 nm that differs from that of the hydrophilic colloid in said one of the hydrophilic colloid layers by at least 0.2 to create a specular density capable of attenuating the infrared beam and activating the processor, and (g) during step (c), the silver halide grain population is developed imagewise to produce the viewable silver images and undeveloped silver halide grains and the particles are removed from the radiographic element.

2. A process according to claim 1 wherein the radiographic element contains less than 65 mg/dm$^2$ of hydrophilic colloid on each side of the support and is processed in less than 90 seconds.

3. A process according to claim 2 wherein the radiographic element contains 35 mg/dm$^2$ of hydrophilic colloid on each side of the support and is processed in less than 45 seconds.

4. A portal localization radiographic element comprised of a transparent film support having first and second major surfaces and, coated on each of the major surfaces, processing solution permeable hydrophilic colloid layers, at least one of said hydrophilic colloid layers on each major surface including a light-sensitized silver halide grain population capable of providing a contrast in the range of from 4 to 8 and containing greater than 50 mole percent chloride and less than 3 mole percent iodide, based on silver, the total grain population being coated at a silver coverage of less than 30 mg/dm$^2$ and having a mean equivalent circular diameter of less than 0.6 $\mu$m, and, in at least one of the hydrophilic colloid layers, high bromide silver halide particles containing less than 3 mole percent iodide based of silver, capable of being removed during processing to create a viewable image in the portal radiographic element, and having an index of refraction in the wavelength range of from 850 to 1100 nm that differs from that of the hydrophilic colloid in said one of the hydrophilic colloid layers by at least 0.2.

5. A portal localization radiographic element according to claim 4 wherein the hydrophilic colloid layers are fully forehardened.

6. A portal localization radiographic element according to claim 4 wherein the silver halide grains have a coefficient of variation of grain size of less than 20 percent.

7. A portal localization radiographic element according to claim 4 wherein the silver halide grains have an average size in the range of from 0.1 to 0.4 $\mu$m.

8. A portal localization radiographic element according to claim 4 wherein the particles consist essentially of silver bromide.

9. A portal localization radiographic element according to claim 4 wherein the particles have an average size in the range of from 0.3 to 1$\mu$m.

10. A portal localization radiographic element comprised of a transparent film support having first and second major surfaces and, coated on each of the or surfaces, processing solution permeable hydrophilic colloid layers, at least one of said hydrophilic colloid layers on each major surface including a light-sensitized silver halide population capable of providing a contrast in the range of from 4 to 8 and containing greater than 50 mole percent chloride and less than 3 mole percent iodide, based on silver, the total grain population coated at a silver coverage of less than 30 mg/dm$^2$ and having a mean equivalent circular diameter of less than 0.6 $\mu$m and, in at least one of the hydrophilic colloid layers, particles capable of being removed during processing to create a viewable in the portal radiographic element, having an average size in the range of from 0.5 to 0.9 $\mu$m, and having an index of refraction in the wavelength rangc of from 850 to 1100 nm that differs from that of the hydrophilic colloid in said one of the hydrophilic colloid layers by at least 0.2.

11. A portal localization radiographic element comprised of a transparent film support having first and second major surfaces and, coated on each of the major surfaces processing solution permeable hydrophilic colloid layers, at least one of said hydrophilic colloid yers on each major surface including a light-sensitized silver halide ipopultion capable of providing a contrast in the range of from 4 to 8 and containing greater than 50 mole percent chloride and less than 3 mole percent iodide, based on silver, the total grain population coated at a silver coverage of less than 30 mg/dm$^2$ and having a mean equivalent circular diameter of less than 0.6 $\mu$m, and, in at least one of the hydrophilic colloid layers, particles capable of being removed during processing to create a viewable image in the portal radiographic element and having a refractive index in the wavelength range of from 850 to 1100 nm that differs from that of the hydrophilic colloid in said one of the hydrophilic colloid layers by at least 0.4.

12. An assemblv comprised of a portal localization radiographic element according to claim 4, 10 or 11, a metal intensifying screen positioned to receive X-radiation prior to the portal radiographic element, and a fluorescent intensifying positioned to receive electrons from the metal intensifying screen.

13. An assembly comprised of a portal localization radiographic element according to claim 4, 10 or 11, a pair of metal intensifying screens on opposite sides of the portal localization radiographic element, and a pair of fluorescent screens, each positioned between a metal intensifying screen and the portal localization radiographic element.

14. A process of confirming the targeting of a beam X-radiation of from 4 to 25 MVp comprised of (a) directing the X-radiation at a subject containing features that are identifiable by differing levels of X-radiation absorption and creating a first latent image of X-radiation penetrating the subject in a radiographic element, (b) placing a shield containing a portal between the subject and the source of X-radiation, directing X-radiation at the subject through the portal, and creating a second latent image superimposed on the first latent image in the radiographic element, (c) employing a processor to convert the latent images to viewable silver images from which intended targeting of the X-radiation passing through the portal in relation to the identifiable features of tile subject is realized, the processor relying on attenuation of an infrared beam of a wavelength from 850 to 1100 nm by the radiographic element for activation,

WHEREIN (d) the radiographic element is comprised of a transparent film support having first and second major surfaces and, coated on each of the major surfaces, processing solution permeable hydrophilic colloid layers, at least one of said layers on each major surface including a light-sensitized silver halide grain population capable of providing a contrast in the range of from 4 to 8 and containing greater than 50 mole percent chloride and less than 3 mole percent iodide, based on silver, the total grain population being coated at a silver coverage of less than 30 mg/dm$^2$ and having a mean equivalent circular diameter of less than 0.6 $\mu$m, (e) during steps (a) and (b), total X-radiation exposure is limited to 10 seconds or less. at least one metal screen capable of emitting electrons when exposed to the X-radiation beam is interposed between the X-radiation beam and the radiographic element and at least one fluorescent intensifying screen is positioned to receive electrons from the metal screen and emit light to expose the radiographic element, (f) when introduced into the processor in step (c), the radiographic element of (d) further contains, in at least one of the hydrophilic colloid layers, particles having an average size in the range of from 0.5 to 0.9 $\mu$m and having an index of refraction in the wavelength range of from 850 to 1100 nm that differs from that of the hydrophilic colloid in said one of the hydrophilic colloid layers by at least 0.2 to create a specular density capable of attenuating the infrared beam and activating the processor, and (g) during step (c), the silver halide grain population is developed imagewise to produce the viewable silver images and undeveloped silver halide grains and the particles are removed from the radiographic element.

15. A process of confinning the targeting of a beam of X-radiation of from 4 to 25 MVp comprised of (a) directing the X-radiation at a subject containing features that are identifiable by differing levels of X-radiation absorption and creating a first latent image of X-radiation penetrating the subject in a radiographic element, (b) placing a shield containing a portal between the subject and the source of X-radiation, directing X-radiation at the subject through the portal, and creating a second latcnt image superimposed on the first latent image in the radiographic element, (c) employing a processor to convert the latent images to viewable silver images from which intended targeting of the X-radiation passing through the portal in relation to the identifiable features of the subject is realized, the processor relying on attenuation of an infrared beam of a wavelength from 850 to 1100 nm by the radiographic element for activation,

WHEREIN (d) the radiographic element is comprised of a transparent film support having first and second major surfaces and, coated on each of the major surfaces, processing solution permeable hydrophilic colloid layers, at least one of said layers on each major surface including a light-sensitized silver halide grain population capable of providing a contrast in the range of from 4 to 8 and containing greater than 50 mole percent chloride and less than 3 mole percent iodide, based on silver, the total grain population being coated at a silver coverage of less than 30 mg/dm$^2$ and having a mean equivalent circular diameter of less than 0.6 $\mu$m, (e) during steps (a) and (b), total X-radiation exposure is limited to 10 seconds or less, at least one metal screen capable of emitting electrons when exposed to the X-radiation beam is interposed between the X-radiation beam and the radiographic element and at least one fluorescent intensifying screen is positioned to receive electrons from the metal screen and emit light to expose the radiographic element, (f) when introduced into the processor in step (c), the radiographic element of (d) further contains, in at least one of the hydrophilic colloid layers, particles having an average size in the range of from 0.5 to 0.9 $\mu$m and having a refractive index in the wavelength range of from 850 to 1100 nm that differs from that of the hydrophilic colloid in said one of the hydrophilic colloid layers by at least 0.4 to create a specular density capable of attenuating the infrared beam and activating the processor, and (g) during step (c), the silver halidgrain population is developed imagewise to produce the viewable silver images and undeveloped silver halide grains and the particles are removed from the radi graphic element.

* * * * *